United States Patent [19]

Winter

[11] Patent Number: 4,906,967

[45] Date of Patent: Mar. 6, 1990

[54] ELECTRONIC CIRCUIT BREAKER WITH WITHSTAND CAPABILITY

[75] Inventor: John M. Winter, Cedar Rapids, Iowa

[73] Assignee: Square D Company, Palatine, Ill.

[21] Appl. No.: 249,240

[22] Filed: Sep. 26, 1988

[51] Int. Cl.[4] ..... H01H 9/00

[52] U.S. Cl. ..... 335/172; 335/195

[58] Field of Search ..... 335/16, 147, 18, 195, 335/172, 176; 361/90–96

[56] References Cited

U.S. PATENT DOCUMENTS

| | | | |
|---|---|---|---|
| 3,440,580 | 4/1969 | Molenaar | 335/35 |
| 3,469,216 | 9/1969 | Shiraishi | 335/16 |
| 4,644,438 | 2/1987 | Puccinelli | 361/96 |

*Primary Examiner*—E. A. Goldberg
*Assistant Examiner*—Lincoln Donovan
*Attorney, Agent, or Firm*—Richard T. Guttman; Thomas B. Lindgren; Mary R. Jankousky

[57] ABSTRACT

An electronic circuit breaker having withstand capability. When the fault current exceeds the required withstand level, the mechanism force trips the circuit breaker. The forces generated by a blow-on contact loop are exerted on the various components of the operating mechanism, including the quick trip latch and secondary latch. As the fault current exceeds the required withstand level, the forces on the operating mechanism exceed the spring force holding together the quick trip latch and secondary latch. These two components rotate as one assembly during a trip operation initiated by energizing the trip coil. In the force trip operation, these two components separate unlatching the mechanism and opening the circuit breaker contacts.

10 Claims, 3 Drawing Sheets

ELECTRONIC CIRCUIT BREAKER WITH WITHSTAND CAPABILITY

This application is a continuation of application Ser. No. 06/922,575 filed on Oct. 20, 1986, now abandoned.

This invention relates to an electronic circuit breaker having withstand capability and in particular to an electronic circuit breaker having a blow-on contact loop.

CROSS REFERENCE TO RELATED APPLICATIONS

The present invention is related to material disclosed in the following copending U.S. applications, all of which are assigned to the same assignee of the present application and are herein incorporated by reference:

Ser. No. 922,966, entitled "Circuit Breaker Arc Stack Assembly" filed Oct. 24, 1986 by J. M. Winter;

Ser. No. 922,577, entitled "Trident Arc Horn for Circuit Breaker" filed Oct. 24, 1986 by A. A. Maulandi, K. J. Green, G. A. Volesky;

Ser. No. 922,968, entitled "Circuit Breaker with Positive Contact Indication" filed Oct. 24, 1986 by J. M. Winter, D. R. Schiefen;

Ser. No. 922,576, entitled "Circuit Breaker Contact Assembly" filed Oct. 24, 1986 by J. M. Winter;

Ser. No. 922,967 entitled "Circuit Breaker Trip Solenoid Assembly" filed Oct. 24, 1986 by J. M. Winter, R. F. Dvorak.

BACKGROUND OF THE INVENTION

The increased use of coordination of the tripping sequences of circuit breakers in a system has placed additional requirements on each individual circuit breaker. To allow the downstream circuit breaker the necessary time to interrupt a fault, the upstream circuit breaker must be able to withstand higher fault currents.

Thermal magnetic circuit breakers of the prior art do not have the capability of withstanding fault currents because their trip levels are dependent upon the magnetic, thermal and other physical characteristics of their components which react to the current level and duration of the overcurrent. Tripping in these circuit breakers is a function of the physical components. The length of time before tripping occurs cannot be easily adapted to meet withstand requirements mandated by a specific system application. With the introduction of electronic circuit breakers, circuit breakers with withstand capability became technically feasible.

A circuit breaker with withstand capability often utilizes the opposing current flow in the line terminal 30 and lower blade 26, as shown in FIG. 5, to create a blow-on electromagnetic force. This blow-on electromagnetic force causes the lower contacts to move upwards against the moving contacts. This force increases the contact pressure and opposes the constriction force which tends to force the contacts apart. Since both the blow-on electromagnetic force and the constriction force increase with the square of the current through the circuit breaker, the blow-on loop is designed so that the blow-on electromagnetic force is always greater than the constriction force, enabling the circuit breaker to withstand required fault level.

As the blow-on electromagnetic force increases, the circuit braker operating mechanism which is latched to hold the contacts closed, must withstand increasing levels of force. When the fault current exceeds the withstand level, it is desirable to quickly trip the circuit breaker to protect the operating mechanism.

Although electronic components are easily adaptable to withstand varying requirements and other time delays, they are relatively slow to sense a fault. Electronic circuit breakers will signal the circuit breaker to trip approximately ten to fifteen milliseconds after sensing a fault. Because of the high current level of withstand requirements of circuit breakers, it is undesirable to postpone the interruption of current for the length of the time signal delay required by the electronic components. The fault interruption requirements of a given circuit breaker generally are much larger than the withstand level requirements of the same circuit breaker. For example, the circuit breaker described herein has a withstand capability of 35,000 amperes and a fault interrupting capability of 200,000 amperes. After the withstand level is exceeded, the current may quickly rise to the maximum fault level, creating excessive forces that may, on occasion damage the circuit breaker components, especially the operating mechanism.

An electromechanical method is thus desirable for tripping the circuit breaker when the fault has exceeded the time delay allowed for the withstand level. Prior art circuit breakers use a high magnetic yoke and armature to trip the latch of the circuit breaker mechanism. That type of device, if malfunctioning or improperly adjusted, may damage the circuit breaker operating mechanisms as current and forces associated with a contact blow-on loop increase.

There is a need for a circuit breaker that utilizes the forces created by the blow-on loop to trip the circuit breaker immediately upon the circuit breaker current exceeding the time and current characteristics of the withstand level requirement.

There is a need for a circuit breaker that quickly interrupts the current after the fault level has surpassed the required withstand level.

These and other features of the invention will become more readily apparent from the following description, claims and drawings.

DESCRIPTION OF THE INVENTION

Figure 1:
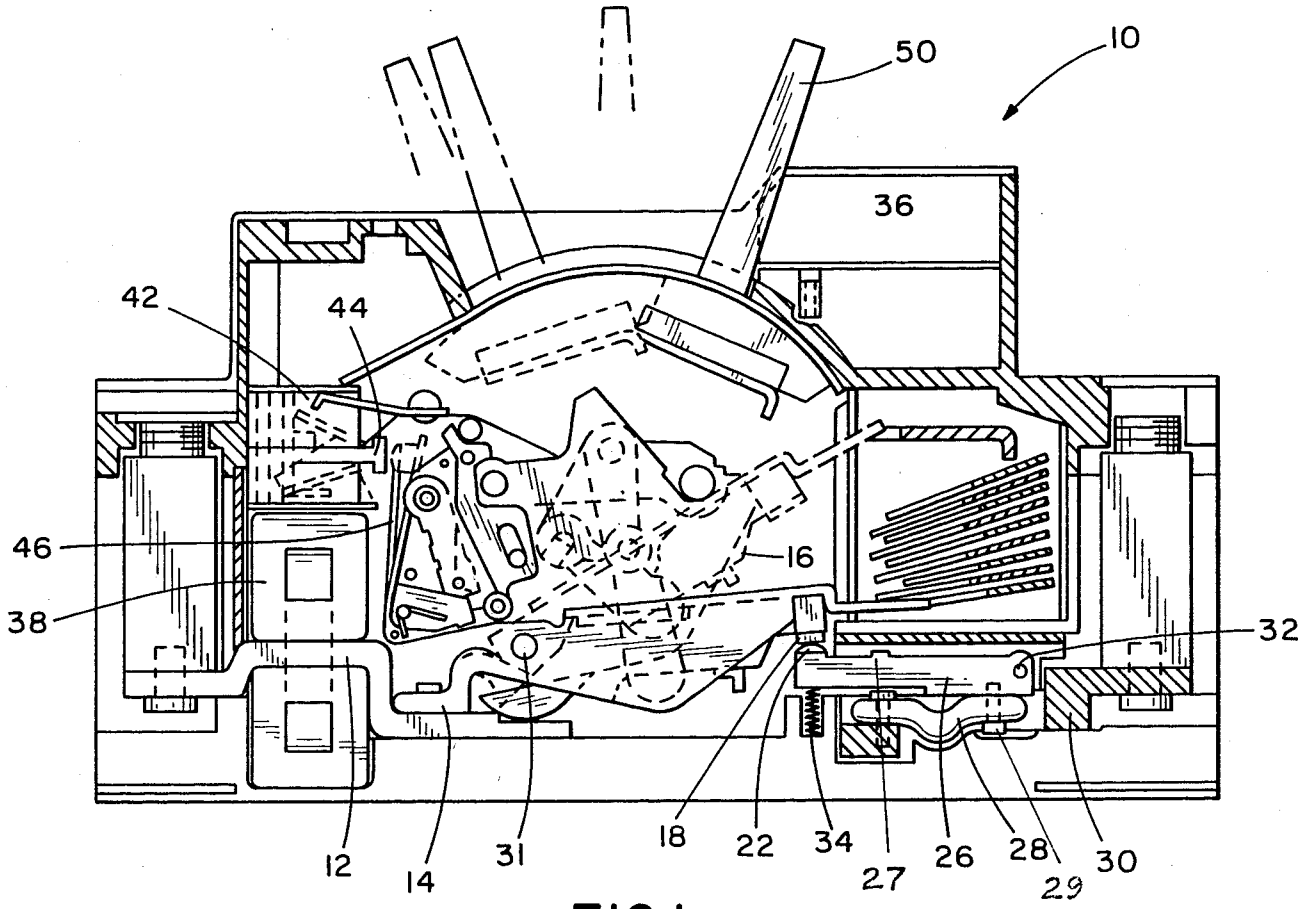
FIG. 1 is a side view of the circuit breaker that is the subject of this invention.
Figure 2:
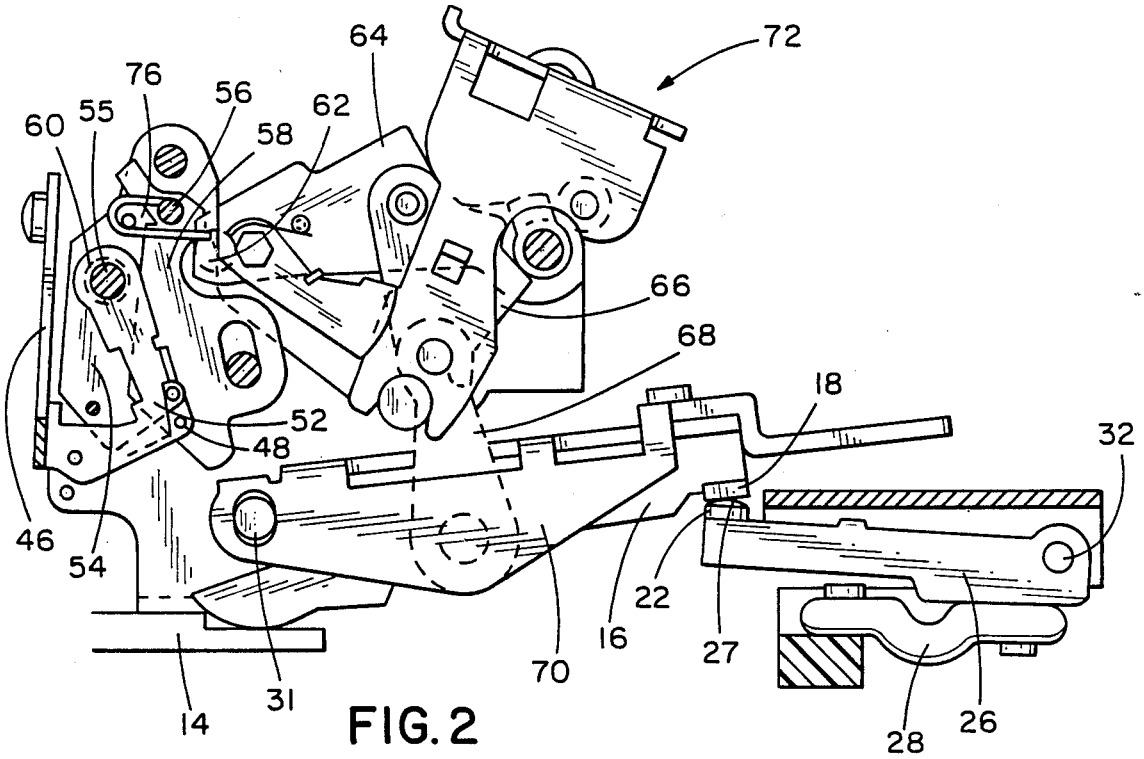
FIG. 2 is a partial side view of the operating mechanism and contact assembly in the closed position.
Figure 3:
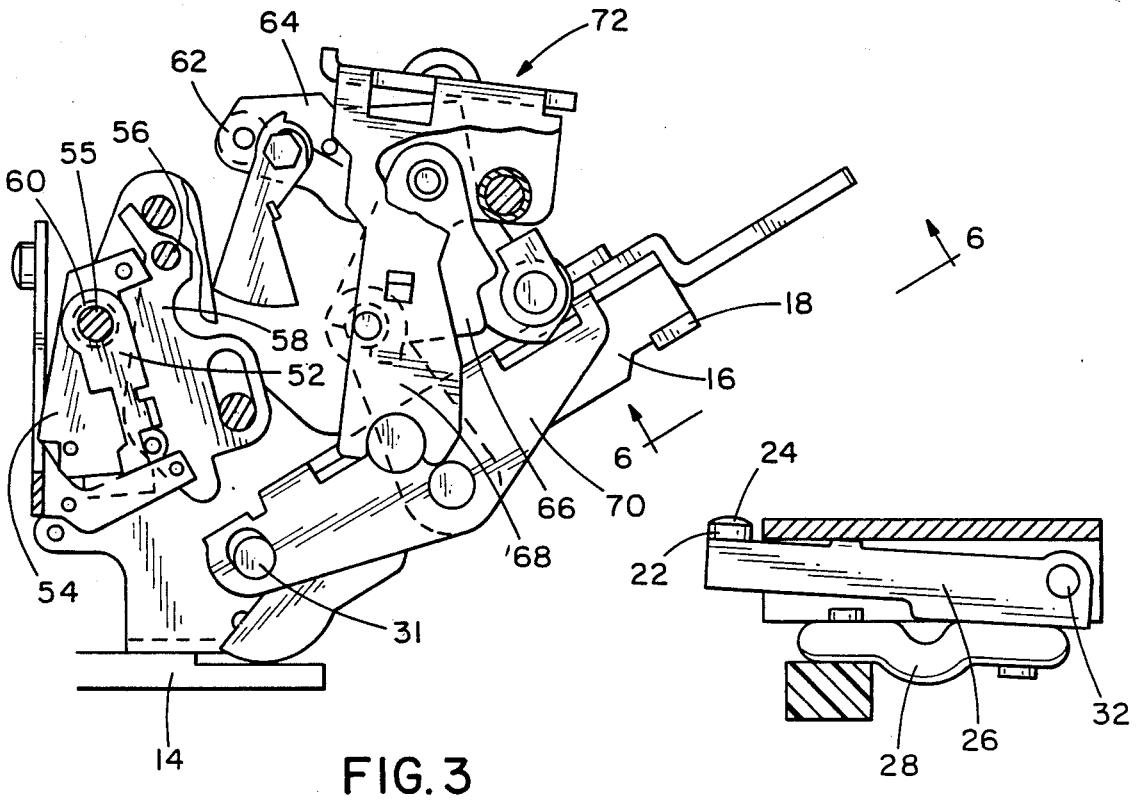
FIG. 3 is a partial side view of the operating mechanism and contact assembly in the tripped position.
Figure 4:
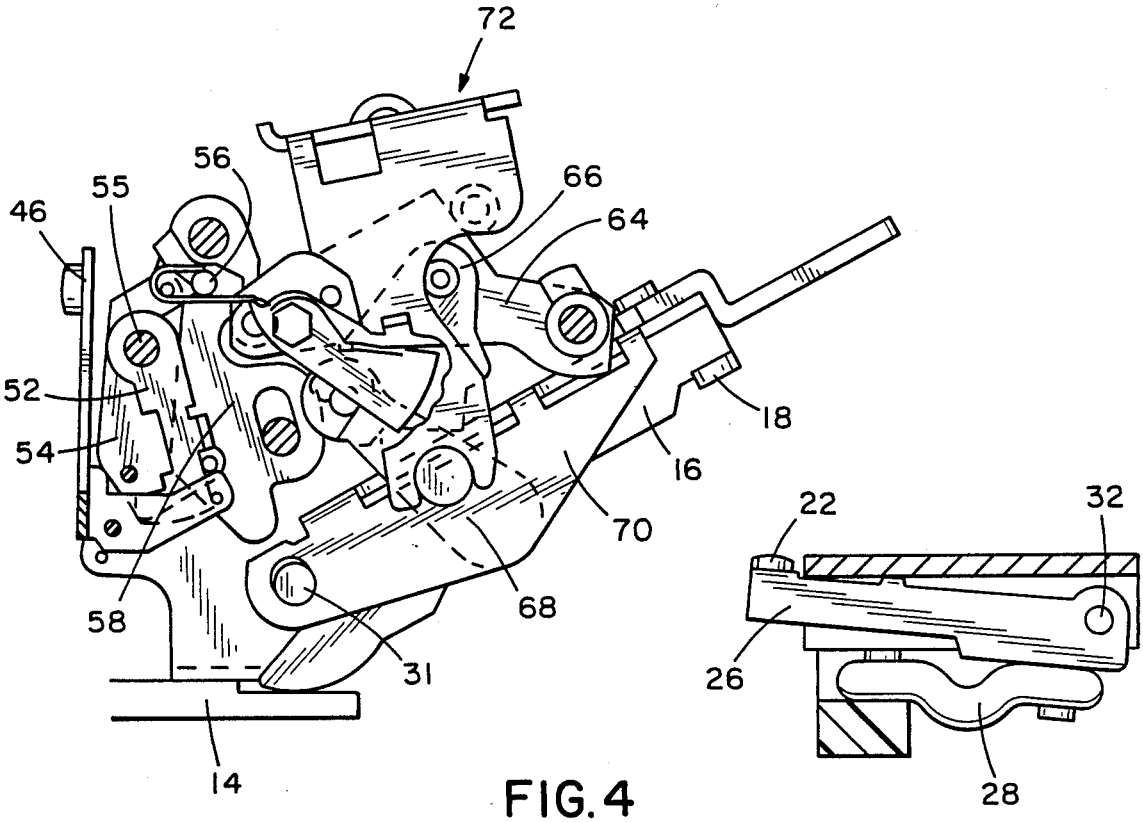
FIG. 4 is a partial side view of the operating mechanism and contact assembly in the manually opened position.
Figure 5:
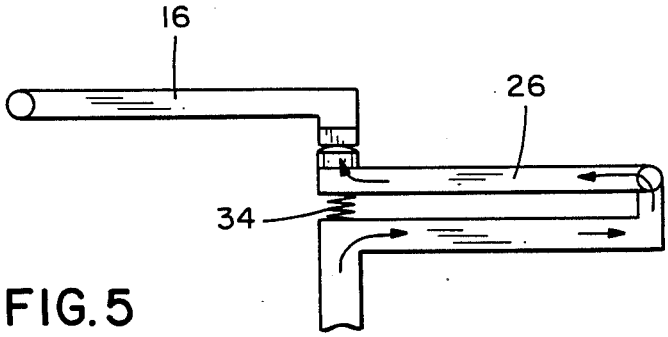
FIG. 5 is a schematic diagram of a contact assembly having a blow on loop.
Figure 6:
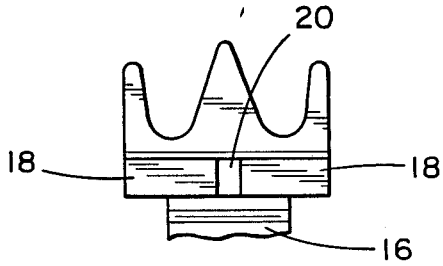
FIG. 6 is a partial bottom view of the moving contacts and arc horn taken along lines 6—6 of FIG. 3.

Referring now to the drawings and in particular to FIG. 1, a circuit breaker, indicated generally as 10, is shown with a double pivot contact assembly. The current path through the circuit breaker 10 is via the load terminal 12, load side flexible connector 14, upper blade 16, moving main contact 18 and moving arcing contact 20, lower main contacts 22 and lower arcing contact 24, lower blades 26, line side flexible connector 28 conductive screw member 29 and line terminal 30.

The withstand capability of circuit breakers is increased by mounting both the upper blade 16 (or moveable blade) and lower blades 26 (or first blades) on pivots 31 and 32, respectively. Constriction force tends to force apart the moving contacts 18 and 20 from the lower contacts 22 and 24 because of the relatively small portion of the contacts that are actually engaged. The constriction force increases with the square of the current through the circuit breaker.

A contact spring 34 mounted between the circuit breaker housing and each lower blade forces each lower blade 26 upwards until stop tab member 27 is pushed against the bottom of the insulative arc stack chamber (not numbered) to create the necessary contact force. At high current levels, such as that required for withstand level capabilities, the constriction forces may force the contacts to pop open.

A blow-on loop is created by the opposite current flow in the line side flexible connector 28 and lower blades 26. The blow-on loop forces the lower main and arcing contacts, 22 and 24, respectively, upwards against the moving main and arcing contacts 18 and 20, respectively, to increase the contact pressure.

The electronic trip assembly, located in cavity 36 of the cover of the circuit breaker housing, signals the circuit breaker to trip upon the occurrence of any one of a number of predetermined fault conditions. The electronic trip assembly monitors the current through the circuit breaker via current transformers 38. Upon determining the existence of an overcurrent, the electronic trip assembly energizes the trip coil 42 causing the plunger 44 to extend and hit the trip lever 46, unlatching the circuit breaker mechanism and opening the contacts.

Upon the plunger 44 hitting the trip lever 46, the trip lever 46 rotates clockwise allowing the trip lever pin 48 to release the secondary latch 52 (or second member). The secondary latch 52 and quick trip latch 54 (or first member) rotate counterclockwise, releasing the cradle latch roller 56 and allowing the cradle latch 58 to rotate counterclockwise. The cradle roller 62 then moves upward as the cradle 64 rotates clockwise, pulling the upper link 66, lower link 68 and blade carrier 70 upwards to separate the moving main contacts 18 and moving arcing contacts 20 from the lower main contacts 22 and lower arcing contact 24. The circuit breaker is returned to the closed position by moving the operating handle 50 to the left as shown in FIG. 1 just past the manually open position (shown in phantom lines) to reset the mechanism. The operating handle is then moved to the right to the closed position.

If the electronic trip curve is set for a relatively long time delay, such as thirty cycles, the circuit breaker may be required to withstand the maximum rated withstand level, here 35,000 amperes. As the current increases, the blow-on electromagnetic force also increases, forcing the upper blade 16 upwards. The circuit breaker operating mechanism, indicated generally as 72, must withstand the resulting forces transferred through the upper blade 16. The circuit breaker that is the subject of this invention has a maximum current rating of 200,000 amperes. To minimize the forces exerted on the trip mechanism 72, the contacts should open immediately after the fault exceeds the required withstand level to avoid subjecting the circuit breaker to higher fault levels. The electronic trip assembly with its 10–15 millisecond reaction time is too slow for this purpose.

The present invention utilizes the blow-on electromagnetic force created by the opposing currents in the line side flexible connector 28 and lower blade 26 to force the trip mechanism to trip after the fault current exceeds the rated withstand level (hereinafter described as a "force trip"). As the blow-on electromagnetic force increases, the lower link 68, upper link 66, cradle 64, cradle latch 58, quick trip latch 54, secondary latch 52 and trip lever 48 are subjected to increased force. As the fault current exceeds the predetermined withstand level, the total upwards force on the upper blade 26, including both blow-on electromagnetic force and contact spring force, reaches the level where the cradle latch roller 56 forces its way past the tip 76 of the quick trip latch 54. This allows both the quick trip latch 54 and cradle latch 58 to rotate counterclockwise. The secondary latch 52 does not rotate during a force trip.

The secondary latch 52 and quick trip latch 54 both rotate about a rod 55. Mounted between the secondary latch 52 and quick trip latch 54 on the rod 65 is a latch spring 60 or resilient member which is a torsion spring holding the secondary latch 52 and quick trip latch 54 relatively stationary with regard to one another.

The secondary latch 52 and quick trip latch 54 move as one unit during a trip operation initiated by energization of the trip coil 42. However, during a force trip operation, the force of the latch spring 60 is overcome by the force generated by the blow-on contact loop, allowing only the quick trip latch 54 to rotate. The cradle 64, upper link 66, lower link 68 and blade carrier 70 all move in the same manner as in a trip operation initiated by energization of the trip coil, as described above. The secondary latch 52 and trip lever 46 remain stationary, The force on the operating mechanism can only reach a certain level before the circuit breaker performs a force trip operation. The trip mechanism 72 is subjected to less stress than prior art design not utilizing the force trip concept. The design is self protecting in that the mechanism will not be damaged during a withstand operation. The operating mechanism will unlatch itself by the force trip operation before damaging levels of force are exerted on the operating mechanism.

While the invention has particularly been shown and described with reference to a preferred embodiment, it will be understood by those skilled in the art that variations in form, construction and arrangement may be made without departing from the spirit and scope of the invention. All such variations are intended to be covered in the appended claims.

I claim:

1. A circuit breaker capable of inherently withstanding very large fault currents with the contacts in the closed position for a predetermined period of time prior to initiating circuit interruption between line and load connectors in response to an over-current condition comprising:

a first contact mounted on a pivoted first blade, the first blade providing a first current path;

a movable contact mounted on a movable blade, the movable blade being movable between an open position and a closed position, said first contact and said movable contact being separated in the movable blade open position, said first contact and said movable contact being engaged in said movable blade closed position;

an operating mechanism moving the movable blade between the open position the the closed position, said operating mechanism including a first member and a second member, said operating mechanism moving the movable blade to the open position upon the activation of either the first member or the second member, said operating mechanism including a trip lever;

the first blade moving upon the occurrence of a fault of a first predetermined level to activate said first member; and the trip lever activating the second member upon the occurrence of a fault of a second predetermined level.

2. A circuit breaker as claimed in claim 1 additionally comprising a conductor connected to said first blade, said conductor being positioned adjacent said first blade and providing a second current path in approximately the opposite direction to the first current path.

3. A circuit breaker as claimed in claim 1 wherein the pivoted first blade exerts force on the movable blade to activate said first member.

4. A circuit breaker as claimed in claim 3 wherein the movement of said first blade is transferred through the movable blade and said operating mechanism to activate said first member.

5. A circuit breaker as claimed in claim 1 wherein said first member and said second member move simultaneously upon said trip lever activating said second second member.

6. A circuit breaker as claimed in claim 5 wherein said first member and said second member are connected together by an adjustable resilient member.

7. A circuit breaker as claimed in claim 4 wherein said first member and said second member each comprise a latch.

8. A circuit breaker as claimed in claim 6 wherein said first member and said second member each comprise a latch.

9. A circuit breaker as claimed in claim 1 wherein said first predetermined level is greater than said second predetermined level.

10. A circuit breaker as claimed in claim 8 wherein said trip lever is signalled to trip upon the occurrence of a fault of a second predetermined level by an electronic trip assembly.

* * * * *